United States Patent [19]

Vulovic

[11] 4,020,954

[45] May 3, 1977

[54] SHIP LOADING RAMP

[75] Inventor: Radoje Vulovic, Swarthmore, Pa.

[73] Assignee: Sun Shipbuilding and Dry Dock Company, Chester, Pa.

[22] Filed: Jan. 5, 1976

[21] Appl. No.: 646,696

[52] U.S. Cl. ..... 214/15 R; 14/71.3; 114/70

[51] Int. Cl.[2] ..... B65G 11/00

[58] Field of Search ..... 214/12, 13, 14, 15 R; 114/43.5 R, 70, 72; 14/70–72

[56] References Cited

UNITED STATES PATENTS

| | | | |
|---|---|---|---|
| 3,320,918 | 5/1967 | Zalejski | 114/70 |
| 3,846,860 | 11/1974 | Kummerman | 214/15 R X |
| 3,933,256 | 1/1976 | Fagerlund | 214/15 R |

FOREIGN PATENTS OR APPLICATIONS

| | | | |
|---|---|---|---|
| 1,014,691 | 12/1965 | United Kingdom | 114/72 |

*Primary Examiner*—Frank E. Werner
*Attorney, Agent, or Firm*—J. Edward Hess; Donald R. Johnson; William C. Roch

[57] ABSTRACT

On a ship, a folding structure serves a dual function of a stern door in its folded position and a ramp in its unfolded position. The first and second decks of the ship have internal ramps which angularly swing up and down to accommodate different heights of the ship relative to the pier. The folding structure may be coupled to the internal ramp on either deck. The capability of coupling the folding structure ramp to either movable internal ramp allows the ship to be loaded or unloaded over wide variations of tide and draft.

3 Claims, 2 Drawing Figures

SHIP LOADING RAMP

BACKGROUND OF THE INVENTION

The subject invention relates generally to a system for loading or unloading a ship, and more particularly pertains to a system wherein a folding structure on a ship serves a dual function of a stern door and a loading ramp which may be coupled to movable first or second deck internal ramps.

Substantial tidal changes in some ports require a special system for coupling a ship to a pier for loading-/unloading over wide variations of tide and draft.

SUMMARY OF THE INVENTION

In accordance with a preferred embodiment, a system is disclosed for coupling a ship to a pier for loading/unloading while allowing for substantial changes in the height of the ship relative to the pier. The ship has first and second decks, and a combination structure which is used as a stern door for the ship when it is folded, and a loading ramp for the ship when it is unfolded. The unfolded loading ramp may be detachably coupled to a movable internal ramp on either the first or second deck of the ship, which allows the ship to be coupled to the pier for loading/unloading despite substantial changes in tide and draft. Further, the ramp system is such as to allow the ship to dock at many different ports without the requirement for special loading equipment in each port. This feature should make the present invention especially useful for military applications. This feature is also advantageous as it results in a negligible investment in port facilities.

DESCRIPTION OF A PREFERRED EMBODIMENT

Figure 1:
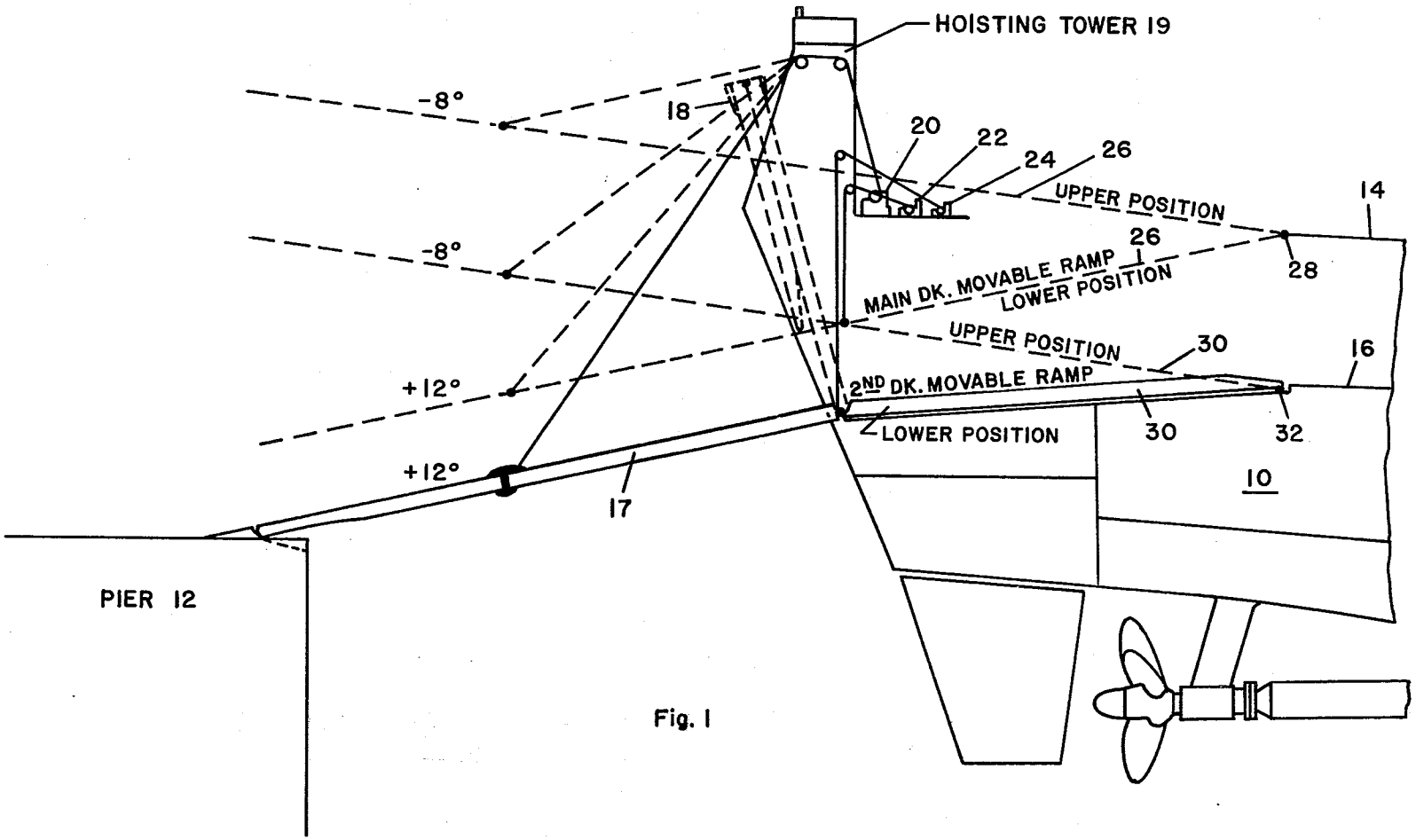
FIG. 1 illustrates a side view of the stern of a ship equipped with one embodiment of the present invention.

Referring to FIG. 1, there is illustrated a side view of the stern of a ship 10 which is docked at a pier 12. The ship includes a main, or first, deck 14, a second deck 16, and may have additional decks. The ship is equipped with a combination stern door-ramp structure, shown in use as a ramp 17. The same structure is shown in phantom while it is being used as a stern door 18. The combination structure is fully extended for use as a ramp, and is folded for use as a stern door.

Figure 2:
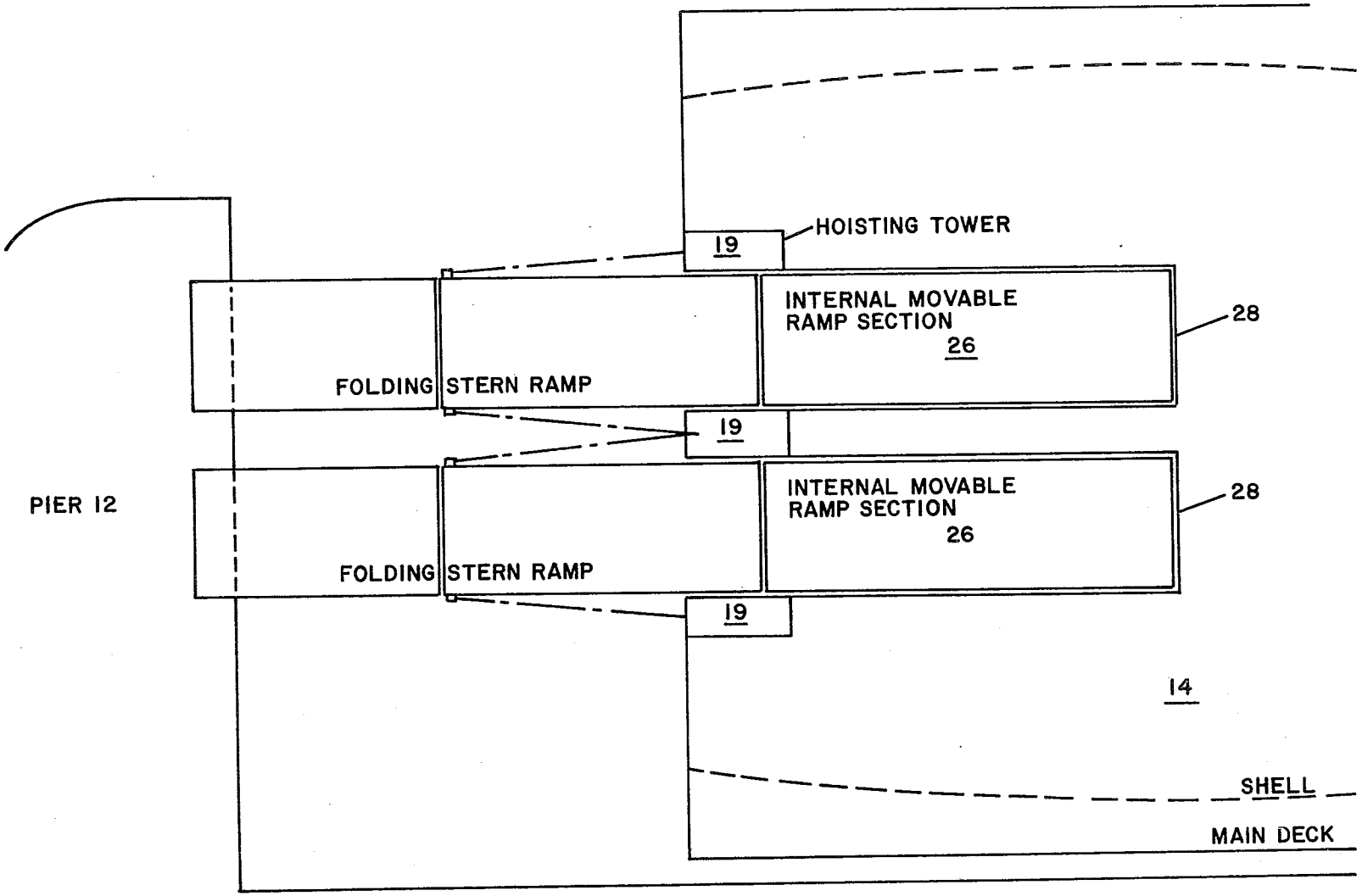
FIG. 2 illustrates a top view of the same structure.

For a more complete understanding of the invention, reference should also be made to FIG. 2 which shows a top view of the main deck 14. During loading/unloading of a ship, it is desirable to have a simultaneous two way flow of cargo handling equipment onto and off of the ship. In the designed embodiment shown in FIG. 2, the structure of the ship was such as to not allow the installation of a single ramp of sufficient width to accomodate a simultaneous two way flow of cargo handling equipment. Accordingly, in the illustrated embodiment, the ship is equipped with two separate ramps for each deck, each of which would carry the flow of cargo handling equipment in an opposite direction. Each ramp on the main deck includes an internal movable ramp section 26 which angularly pivots up and down about its forward section 28, as illustrated best in FIG. 1. Likewise, each ramp on the second deck is equipped with a movable ramp section 30 which is angularly pivotably up and down about its forward section 32, as shown best in FIG. 1. The ship further includes a hoisting tower 19 positioned on each side of each ramp. Each hoisting tower is equipped with ramp handling winches 20, 22 and 24. Each winch 22 on each side of each movable ramp section 30 is utilized to raise and lower the stern portion of that ramp section. Likewise, each winch 24 on each side of each movable ramp section 26 is utilized to raise or lower the stern portion of that ramp section. The third winch 20 is utilized to raise and lower the combination structure as illustrated by the various angular positions shown in phantom in FIG. 1. The ship would also include other permanent ramps extending between the first and second decks, not shown in the figures, such that cargo could readily be moved between the decks.

During normal travel of the ship, the combination stern door-ramp structure 17 is folded and pivotably coupled to the second deck to serve as stern doors for both the first and second decks. Upon arrival at a port, the combination structure would be unfolded. It tide and draft conditions were such that the ship were substantially elevated with respect to the pier, as illustrated in FIG. 1, the combination structure would remain coupled to the second deck and would merely be extended to serve as a ramp to the second deck. If the combination of tide and draft were such that the level of the ship were substantially below the level of the pier, the winches 22 would be utilized to raise the movable ramp sections 30 to their upper positions, and the winches 24 would be utilized to lower the ramp sections 26 to their lower positions such that the stern portions of the ramp sections 26 and 30 would be substantially adjacent to each other. In these positions, the combination structure could be switched to pivotably couple it to the main deck ramp sections 26 rather than the second deck ramp sections 30. The angular position of the main deck ramp sections 26 would then be adjusted by winches 24, and the combination structure would be lowered and unfolded by winches 20 to allow the unfolded ramp structure 17 to extend between the ship and the pier at the proper angle. In an alternative embodiment the ramp structures may be moved by hydraulic equipment rather than by winches.

In one designed embodiment wherein the ship was of the Class Ponce de Leon, built by Sun Shipbuilding and Drydock Co., the ramps were designed to cover the angular swings shown in FIG. 1, and with the particular dimensions of that ship it would be possible to cover as much as a 52 foot change of tide and draft. Unfortunately, the system of the present invention results in a loss of cargo space. In the particular designed embodiment where the ship normally carries roll-on-roll-off trailers, the number of lost trailer space would be approximately 10 which results in a loss of approximately 325 tons of cargo. The added weight of the structure required for the present invention would not exceed the cargo weight lost.

The movable ramp sections 26 and 30 may be the type sold by MacGregor Comarain, Inc.

Although at least one embodiment of the present invention has been described, the teachings of this invention will suggest many other embodiments to those skilled in the art.

The invention claimed is:

1. A system designed to couple a ship to a pier for loading/unloading while allowing for substantial changes in the height of the ship relative to the pier caused by changes in tide and draft, comprising:

a. a ship having at least first and second decks with each of said first and second decks having an internal movable loading ramp and with the internal movable loading ramp of the first deck being located vertically above the internal movable loading ramp of the second deck, each internal loading ramp having a ship end toward the ship and a pier end toward the pier and means for pivotably mounting each internal loading ramp to the deck at its ship end to enable the pier end of the ramp to move angularly up and down relative to the ship end of the ramp;

b. said ship having a folding combination door-ramp means, said combination means being used as a door on the ship when it is folded and being utilized as a ramp extending from the ship to a pier when it is unfolded;

c. means for detachably coupling said combination means for use as a ramp to the pier end of the internal movable loading ramp of either of said two decks, whereby the coupling of the combination door-ramp means to the internal movable loading ramp of either of said two decks allows the ship to be coupled to the pier for loading/unloading despite substantial changes in tide and draft.

2. A system as set forth in claim 1 wherein said door is a stern door which provides access to both a main deck and a second deck of the ship, said door is pivoted about its bottom and has a top section and a bottom section foldable with respect to said top section.

3. A system as set forth in claim 2 wherein the door-ramp means includes two foldable stern doors, each of which is adapted to be unfolded to form a ramp, with one ramp being for loading of the ship and the second ramp being for unloading of the ship.

* * * * *